United States Patent [19]

Farney et al.

[11] 4,082,979

[45] Apr. 4, 1978

[54] METHOD AND APPARATUS FOR REDUCING NOISE IN CROSSED-FIELD AMPLIFIERS

[75] Inventors: George K. Farney; Fred A. Feulner, both of Boxford, Mass.

[73] Assignee: Varian Associates, Inc., Palo Alto, Calif.

[21] Appl. No.: 727,722

[22] Filed: Sep. 29, 1976

[51] Int. Cl.[2] ..... H01J 25/34

[52] U.S. Cl. ..... 315/39.3; 315/3.5; 315/3.6; 330/43

[58] Field of Search ..... 315/3.5, 3.6, 39.3; 330/43

[56] References Cited

U.S. PATENT DOCUMENTS

| | | | |
|---|---|---|---|
| 3,069,587 | 12/1962 | Dench | 315/39.3 X |
| 3,069,594 | 12/1962 | Feinstein | 315/39.3 |
| 3,609,581 | 9/1971 | McDowell | 315/39.3 |
| 3,733,509 | 5/1973 | Wilczek | 315/3.6 |
| 3,863,100 | 1/1975 | Belohoubek | 315/39.3 |

*Primary Examiner*—Saxfield Chatmon, Jr.
*Attorney, Agent, or Firm*—Stanley Z. Cole; Peter J. Sgarbossa

[57] ABSTRACT

Noise in reentrant-stream crossed-field amplifiers is suspected of being generated by electrons re-entering the interaction region with large amplitude cycloidal motion near the slow-wave circuit. Means to increase the electric field in a portion of the drift region preceding the circuit lowers the noise, presumably by collecting these electrons. The field may be increased by decreasing the spacing between cathode and drift electrode or by applying a bias voltage on an insulated electrode.

22 Claims, 5 Drawing Figures

FIG.1
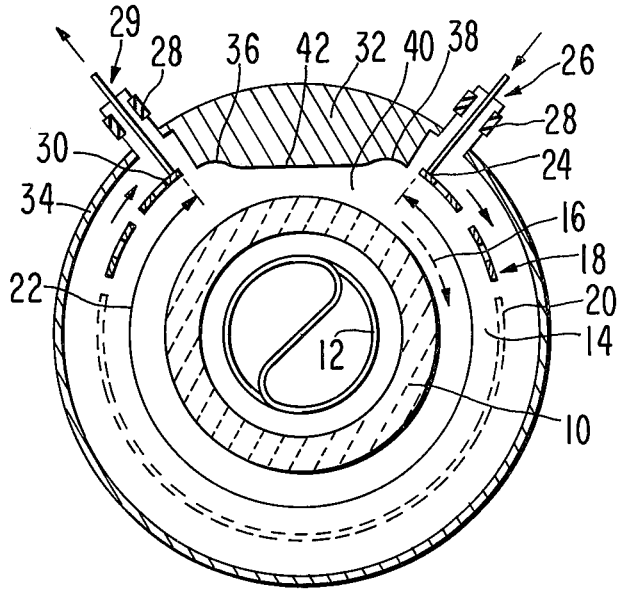
FIG.2
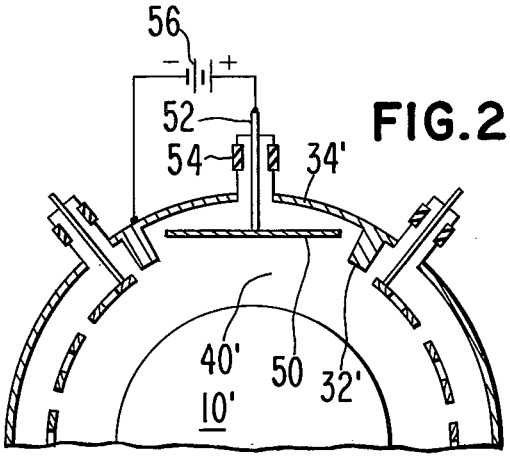
FIG.3
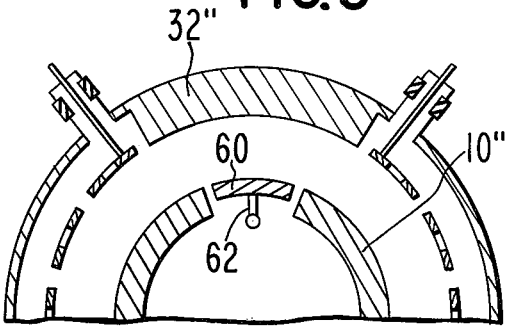
FIG. 4
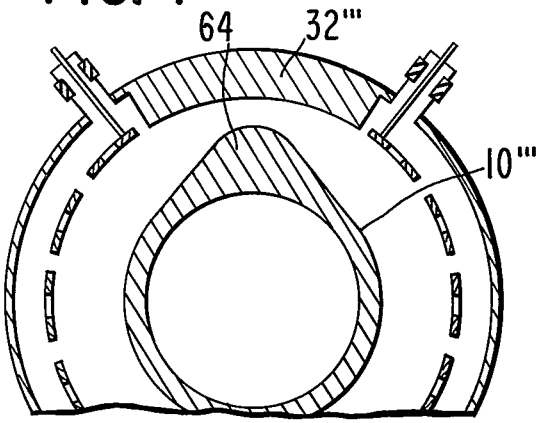
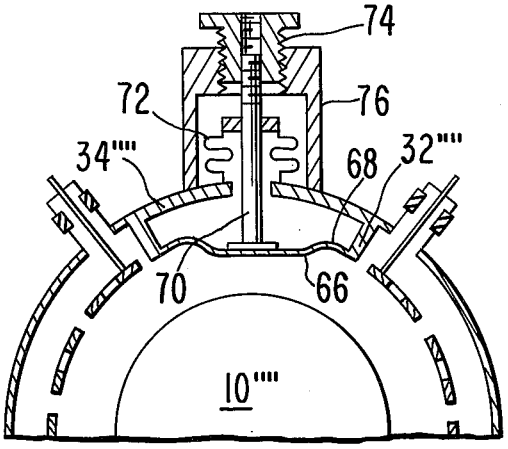
FIG.5

METHOD AND APPARATUS FOR REDUCING NOISE IN CROSSED-FIELD AMPLIFIERS

FIELD OF THE INVENTION

The invention pertains to crossed-field amplifiers (CFA's) in which a stream of electrons interact with an electromagnetic wave in a slow-wave circuit and the uncollected electrons recirculate through a drift space to reduce their rf modulation, then reenter the interaction region. Reentrant CFA's have improved efficiency because some of the energy left in the electron stream is converted to wave energy on subsequent traverses.

PRIOR ART

It has long been known that reentrant stream CFA's have higher noise levels than many other types of microwave amplifiers. Noise phenomena are described in "Electronic Engineers Handbook", McGraw-Hill 1975, pages 9–57. The excessive noise has been vaguely believed to be due to non-phase-locked electrons in the reentering stream, but no clear explanation has been proposed. It is known that noise is reduced as the input rf drive signal is increased so as to more quickly lock the electrons circulating near the slow-wave circuit into distinct "spokes". This inherent sacrifice of gain is of course undesirable. U.S. Pat. No. 3,069,594 issued Dec. 18, 1962 to J. Feinstein describes a method of increasing the gain while maintaining stability by tapering the phase shift per section of the slow wave circuit. Tapering of the circuit-to-cathode spacing along the length of the circuit is also disclosed as a means of improving the interaction efficiency.

Copending Patent application No. 683,990 filed May 6, 1976 by George K. Farney describes another method of improving efficiency and gain by tapering the pitch of the periodic circuit. Variations in circuit-to-cathode spacings along the length of the interaction circuit are also disclosed to control the magnitude of the rf field near the cathode surface.

For a quite different purpose, U.S. Pat. No. 3,560,867 issued Feb. 2, 1971 to P. N. Hess describes a variation of the magnetic field in the drift region to collect some of the electron stream in this region so that the number of electrons reentering the interaction region is insufficient to support an oscillation when the drive signal is removed. Thus the amplifier is self-modulated as controlled by a pulsed rf drive.

SUMMARY OF THE INVENTION

An object of the invention is to provide a method of operating a crossed-field amplifier having reduced noise.

Another object is to provide a CFA tube which generates a reduced level of noise.

Another object is to provide an amplifier which will operate with reduced drive power.

These objects are achieved by providing in the drift space a region of higher dc electric field in which electrons in orbits taking them near the anode are collected by the drift electrode. The electron stream re-entering the interaction region then has very few electrons passing close to the input end of the slow-wave circuit. Such electrons could induce large noise-currents in the circuit near the input end, whence the induced noise signal is amplified by the gain of the amplifier. In order to avoid generation of large cycloidal motions of electrons by the change of electric field, the fields at the ends of the drift space are preferably made equal to the fields in the adjoining interaction space. The field is then gradually increased toward the center of the drift space to produce the desired skimming of the beam. The field change can be produced by varying the spacing between cathode and drift electrode or by adding an electrode with a dc bias.

BRIEF DESCRIPTION OF THE DRAWINGS

FIG. 1 is a schematic section perpendicular to the axis of a CFA embodying the invention.

FIG. 2 is a similar section of an embodiment comprising a bias anode electrode.

FIG. 3 is a schematic section of another embodiment including a bias cathode electrode.

FIG. 4 is a schematic section of an embodiment including a non-circular cathode.

FIG. 5 is a variation of FIG. 1 including adjustable electrode spacing.

DESCRIPTION OF THE PREFERRED EMBODIMENTS

The CFA of FIG. 1 has a cylindrical cathode 10 as of porous tungsten impregnated with barium aluminate. Cathode 10 is heated by a radiant heater 12 such as a bifilar helix of tungsten coated with alumina insulation. Surrounding cathode 10 is an anode structure radially spaced to provide a roughly toroidal passage 14 for a recirculating stream of electrons 16. The anode structure comprises a slow-wave circuit 18 shown schematically as an array of periodically spaced bars 20 such as the vertical members of a meander line. However, many other types of slow-wave circuits may be used.

Slow-wave circuit 18 extends around the greater part of the circumference of cathode 10, defining the interaction regi 22 therebetween. An rf drive signal is applied to the input end 24 of circuit 18 from input transmission line 26, such as a coaxial line, through a ceramic window 28 in the vacuum envelope 34. The output end 30 of circuit 18 is connected to a similar transmission line 29 to carry off the amplified signal. Circuit 18 is operated at the dc potential of tube envelope 34, customarily grounded.

Over the portion 40 of passage 14 between the output 30 and input 24, the anode structure comprises a non-propagating drift electrode 32 which may structually be an inward-projecting extension of the tube body shell 34, as of copper. At its ends 36 and 38, the inner surface of drift electrode 32 has the same spacing from cathode 10 as the adjacent ends 30 and 24 of circuit 18. Thus the stream of electrons can flow in and out of the drift space 40 between electrode 32 and cathode 10 without perturbations caused by abrupt changes in the dc field.

Inward from ends 36 and 38 of electrode 32, its inner surface 42 is shaped to gradually and smoothly diminish the spacing between surface 42 and cathode 10.

Applicants have found that the aforedescribed tapering of the spacing can provide a remarkable improvement in the noise generated in the CFA. A tube was built with a chord-shaped insert in the normally cylindrical drift electrode. This tube showed a surprising reduction of 5db in noise compared to otherwise identical prior-art tubes with uniform spacing.

The electron trajectories and interactions in a crossed-field tube are very complex and not well understood. We believe, however, that the improved performance is due to the increase in electric field strength caused by the reduced spacing. Therefore, other means of increasing the electric field should also provide noise reduction.

FIG. 2 is a schematic illustration of an embodiment of the invention in which the increased electric field is produced by a section 50 of the drift electrode 32' which is supported by a conductive rod 52 mounted via an insulating seal 54 on tube body 34'. A bias voltage 56 is applied to section 50, positive with respect to body 34'. Thus without decreasing the spacing from the cathode, the electric field between electrode 50 and cathode 10' is locally increased. The face of electrode 50 need not be on the cylindrical surface defined by circuit 18' but may be contoured to provide the desired rate of change of field with distance along the drift space 40'.

FIG. 3 shows a different embodiment in which the increased field is produced by an insulated electrode 60 replacing part of the circumference of the otherwise cylindrical cathode 10'' opposite drift electrode 32''. In this case a bias potential negative to the potential of cathode 10'' is applied to the electrode 60 via its supporting lead 62 from a bias source (not shown). An electrode physically somewhat resembling electrode 60 is described in U.S. Pat. No. 3,255,422 issued June 7, 1966 to J. Feinstein et al. They used it to turn off the pulses by collecting electrons when a pulse voltage was applied to it positive with respect to the cathode. According to the present invention, electrode 60 could serve the dual purpose of noise reduction by a negative bias during the pulse and turn-off by a positive pulse to cause termination of the rf pulse.

FIG. 4 shows still another embodiment in which the spacing between cathode 10''' and drift electrode 32''' is decreased by proving cathode 10''' with a non-circular section comprising a protruberance 64.

FIG. 5 illustrates a modification of the embodiment of FIG. 1 in which the spacing of a portion of drift electrode 32'''' from the cathode 10'''' is made adjustable so that the optimum conditions for low noise and high efficiency can be set for each tube. A central portion of drift electrode 32'''' is made as a relatively thin strap 66, as of copper, so that it can be deformed. The ends 68 of strap 66 are convoluted so it can bend without kinking or stretching. A push-rod 70 is attached to strap 66, passing out through vacuum envelope 34'''' via a flexible metallic bellows 72. The outer end of push-rod 70 is moved radially of the CFA by a differential screw drive nut 74 bearing in a mount 76 fixed to envelope 34''''.

We surmise that the observed noise reduction may be due to removal by collection on the drift electrode of electrons which would otherwise re-enter the interaction region very close to the circuit where they can induce excessive noise on it. These electrons may have large-amplitude cycloidal perturbations superposed on their circulating drift orbits. It is believed that abrupt changes in the dc field could excite large cycloidal components on electron orbits that otherwise would be relatively smooth. For this reason, the smooth changes in field used in the experimental tube and illustrated e.g. by the construction of FIG. 1 may be especially beneficial.

The above-described embodiments of the invention are illustrative only. The true scope is intended to be defined only by the following claims and their legal equivalents.

We claim:

1. A method of operating a crossed field amplifier at a low noise level, said amplifier comprising:
   - an extended reentrant passage for a recirculating stream of electrons,
   - cathode means adjacent said passage over most of its extent,
   - slow-wave circuit means adjacent said passage and opposite said cathode means, extending over an interaction section of said passage,
   - non-propagating drift electrode means adjacent said passage and opposite said cathode means, extending over a drift section of said passage,
   - said method including:
   - applying a magnetic field generally parallel to said cathode means and perpendicular to the extend of said passage,
   - applying a first electric field strength between said cathode means and said circuit means, and
   - applying between said cathode means and a portion of said drift electrode means inwardly from both ends of said drift section a second electric field strength higher than said first strength.

2. A method of operating a crossed field amplifier at a low noise level, said amplifier comprising:
   - an extended reentrant paassage for a recirculting stream of electrons,
   - cathode means adjacent said passage over most of its extent,
   - slow-wave circuit means adjacent said passage and opposite said cathode means, extending over an interaction section of said passage,
   - non-propagating drift electrode means adjacent said passage and opposite said cathode means, extending over a drift section of said passage,
   - said method including:
   - applying a magnetic field generally parallel to said cathode means and perpendicular to the extent of said passage,
   - applying a first electric field strength between said cathode means and said circuit means, and
   - applying between said cathode means and a portion of said drift electrode means a second electric field strength higher than said first strength including applying a voltage different from the voltages on said cathode and said circuit to a bias electrode adjacent a portion of said section and insulated from said cathode and said circuit.

3. The method of claim 2 wherein said bias electrode is opposite said cathode.

4. The method of claim 2 wherein said bias electrode and said cathode are on the same side of said passage.

5. A method of operating a crossed field amplifier at a low noise level, said amplifier comprising:
   - an extended reentrant passage for a recirculating stream of electrons,
   - cathode means adjacent said passage over most of its extent,
   - slow-wave circuit means adjacent said passage and opposite said cathode means, extending over an interaction section of said passage,
   - non-propagating drift electrode means adjacent said passage and opposite said cathode means, extending over a drift section of said passage,
   - said method including:
   - applying a magnetic field generally parallel to said cathode means and perpendicular to the extent of said passage, applying a first electric field strength between said cathode means and said circuit means, and applying between said cathode means and a portion of said drift electrode means a second electric field strength higher than said first strength including applying a voltage, equal to the voltage between said cathode and said circuit, between said cathode and a portion of said drift electrode means, the spacing between said portion and said cathode being less than the spacing between said cathode and said circuit.

6. In a crossed-field amplifier:

an extended reentrant passage for a recirculating stream of electrons, said passage comprising an interaction section and a drift section, cathode means adjacent said passage over most of its extent, slow-wave circuit means adjacent said passage extending over said interaction section, and opposite said cathode means, non-propagating drift electrode means adjacent said passage and opposite said cathode means extending over at least a portion of said drift section, means for applying a first electric field strength between said cathode means and said circuit means.

means for applying between said cathode means and said drift electrode means a second electric field strength which at the ends of said drift section is substanitally equal to said first strength and which at a first position inwardly of said ends is of a value substantially higher than said first strength.

7. The apparatus of claim 6 wherein said means for applying said second field strength comprises, a first spacing, between a portion of said cathode means and a portion of said drift electrode means, said first spacing being smaller than the spacing between said cathode means and said circuit means.

8. The apparatus of claim 7 wherein said cathode means comprises an active surface lying substantially on the surface of a first right circular cylinder, and wherein the surfaces of said circuit and said ends of said drift electrode facing said cathode lie substantially on the surface of a second right circular cylinder parallel to said first cylinder, and wherein said portion of said drift electrode protrudes from said surface of said second cylinder toward said first cylinder.

9. The apparatus of claim 7 including means for electrically connecting said drift electrode means and said circuit means.

10. In a crossed-field amplifier:

an extended reentrant passage for a recirculating stream of electrons, said passage comprising an interaction section and a drift section, cathode means adjacent said passage over most of its extent, slow-wave circuit means adjacent said passage extending over said interaction section, and opposite said cathode means, non-propagating drift electrode means adjacent said passage and opposite said cathode means extending over at least a portion of said drift section, means for applying a first electric field strength between said cathode means and said circuit means, means for applying between said cathode means and said drift electrode means a second electric field strength which at the ends of said drift section is substantially equal to said first strength and which increases gradually with distance from said ends to a value substantially higher than said first strength, said means for applying said second field strength comprising a bias electrode adjacent said drift section of said passage and insulated from said cathode and said circuit.

11. The apparatus of claim 10 wherein said bias electrode is a part of said drift electrode means.

12. The apparatus of claim 10 wherein said bias electrode is opposite said drift electrode.

13. In a crossed-field amplifier:

an extended reentrant passage for a recirculating stream of electrons, said passage comprising an interaction section and a drift section, cathode means adjacent said passage over most of its extent, slow-wave circuit means adjacent said passage extending over said interaction section, and opposite said cathode means, non-propagating drift electrode means adjacent said passage and opposite said cathode means extending over at least a portion of said drift section, means for applying a first electric field strength between said cathode means and said circuit means, means for applying between said cathode means and said drift electrode means a second electric field strength which at the ends of said drift section is substantially equal to said first strength and which increases gradually with distance from said ends to a value substantially higher than said first strength, said means for applying said second field strength comprising a first spacing between a portion of said cathode means and a portion of said drift electrode means said first spacing being smaller than the spacing between said cathode means and said circuit means; and means for mechanically adjusting said first spacing.

14. The apparatus of claim 6 wherein the value of said second field strength increases gradually with distance inwardly from both said ends of said drift section to said first position.

15. The apparatus of claim 14 wherein said first position is generally midway of said ends of said drift section.

16. The apparatus of claim 7 wherein the spacing between said cathode means and said circuit means is substantially equal to the spacing between said cathode means and both said ends of said drift section.

17. The apparatus of claim 16 wherein said first spacing is located generally midway of said ends of said drift section.

18. The apparatus of claim 16 wherein said spacing between said cathode means and both said ends of said drift section decreases gradually, inwardly of said ends, toward said first spacing.

19. The apparatus of claim 18 wherein said cathode protrudes toward said drift section to define said first spacing.

20. The apparatus of claim 18 wherein said drift section protrudes toward said cathode to define said first spacing.

21. The method of claim 1, which further includes the step of applying between said cathode means and said drift electrode an electric field which increases in value gradually with distance inwardly from both said ends of said drift section to said second electric field strength.

22. The method of claim 21 wherein said first electric field strength is applied between said cathode means and both said ends of said drift section, and increased gradually inwardly therefrom to said second electric field strength applied between said cathode and said portion of said drift electrode.

* * * * *